US006279642B1

(12) United States Patent
Liu

(10) Patent No.: US 6,279,642 B1
(45) Date of Patent: Aug. 28, 2001

(54) FIXING DEVICE IN A VENETIAN BLIND

(76) Inventor: Feng-Chin Liu, 3F, No.2, Alley 7, Lane 207, Sec. 3, Shing Long Road, Taipei (TW)

( * ) Notice: Subject to any disclaimer, the term of this patent is extended or adjusted under 35 U.S.C. 154(b) by 0 days.

(21) Appl. No.: 09/545,855

(22) Filed: Apr. 10, 2000

(30) Foreign Application Priority Data

Jan. 12, 2000 (TW) ..... 089200506

(51) Int. Cl.[7] ..... E06B 9/38
(52) U.S. Cl. ..... 160/177 R; 160/176.1 R
(58) Field of Search ..... 160/177 R, 176.1 R, 160/178.1 R, 168.1 R, 178.3 R

(56) References Cited

U.S. PATENT DOCUMENTS 2,831,536 * 4/1958 Lorentzen ..... 160/177 R
3,269,453 * 8/1966 Vecchiarelli et al. ..... 160/176.1 R
3,333,905 * 8/1967 Hennequin ..... 160/178.1 R
5,538,068 * 7/1996 Liu ..... 160/177 R
5,573,052 * 11/1996 Liu ..... 160/177 R
5,638,882 * 6/1997 Morris ..... 160/176.1 R

* cited by examiner

*Primary Examiner*—Blair M. Johnson
(74) *Attorney, Agent, or Firm*—Dougherty & Troxell

(57) ABSTRACT

A fixing device in a venetian blind integrally made of high molecular material comprises a cord engaging part, a band passing part, and a core. The cord engaging part is at one side of a base, having two engaging plates oppositely and crossly disposed and a joint to connect with each other. Each of the engaging plates has an engaging groove near the joint thereof, and an engaging chamber is formed in the base. The band passing part is at the other side of the base having two opposite and crossly arranged sticks. An elongated gap formed between each stick and one edge on the base respectively and a bottom gap formed between the bottom part of each stick and the base respectively. The core is at the center of the base is formed at center of the base with a central axial through hole along the base.

4 Claims, 3 Drawing Sheets

FIXING DEVICE IN A VENETIAN BLIND

BACKGROUND OF THE INVENTION

1. Field of The Invention

The present invention relates to a fixing device in a venetian blind, and particularly to an improvement of a fixing device for a bracing cord and a positioning band in a venetian blind.

2. Description of Related Art

Usually, a venetian blind is a very popular window shade and is one of basic arrangements adopted when building a house. In order to block the light as desired, the venetian blind can be operated to locate the slats thereof at a specific height and to move the slats angularly as desired respectively.

As shown in FIG. 5, it is know that a venetian blind has a rod B at the top thereof and fixing devices are mounted on the rod B at a certain interval to fix the bracing cord or the positioning band. In addition, the cord or the band may move downward and be associated with the slats such that a controller at a lateral side of the venetian blind can be operated to turn the slats and to adjust the height of the slats.

The fixing device mentioned above is used to fix the bracing cord or the positioning band. How to fix the bracing cord or the positioning band and how to fix the fixing device on the rod B are subjects have to be considered virtually.

Originally, a conventional fixing device in a venetian blind is divided into two types: one is designed for fixing a bracing cord and the other one is designed for fixing a positioning band. In order to reduce the production cost and the inventory cost, a dual fixing device was developed, which can not only fix the bracing cord but also the positioning band, instead of using two different fixing devices.

For instance, U.S. Pat. No. 5,573,052, which is entitled "POSITIONING DRUM DEVICE FOR A VENETIAN BLIND", is a dual fixing device for fixing the bracing cord and the positioning band respectively. The device provides two opposite fixing faces such that one of which admits and fixes the bracing cord and the other one of which admits and fixes the positioning band. A closed end portion at the fixing face for the positioning band has two extending elongated rods to perform a fixing job. Two parallel head rails and a passage are provided on the fixing face to be passed through by the cord and performing a fixing job.

Although a dual fixing device can achieve the basic function required for fixing the bracing cord and the positioning band, the elongated rods are parallel to each other and attached to an inner wall of the closed end portions. It results in a force exerting in a direction perpendicular to the inner wall such that a great stress may cause to create a problem of insufficient strength. It is a tedious work to repair or replace the venetian blind after it is out of order such that a life span for a venetian blind is a factor that has to be considered while the venetian blind is made. Furthermore, there are several fixing devices that have to be mounted on a shaft at least so that the orientation of each fixing device has to be located correctly when the assembling job is executed and it often leads to a substantially lower working efficiency. In addition, both lateral sides of each fixing device are flatly cut faces and provided with a central hole respectively available for the shaft passing through such that the shaft subjects to a heavier load. Thus, an engaging seat A fitting with an upper rail becomes useless so as to lessen the durability of the fixing device.

SUMMARY OF THE INVENTION

An object of the present invention is to provide a fixing device in a venetian blind, which is arranged to have a better strength and durability.

Another object of the present invention is to provide a fixing device in a venetian blind, which is arranged to be easily mounted.

BRIEF DESCRIPTION OF THE DRAWINGS

The present invention can be more fully understood by reference to the following description and accompanying drawing, in which.

DETAILED DESCRIPTION OF THE PREFERRED EMBODIMENTS

Figure 2:
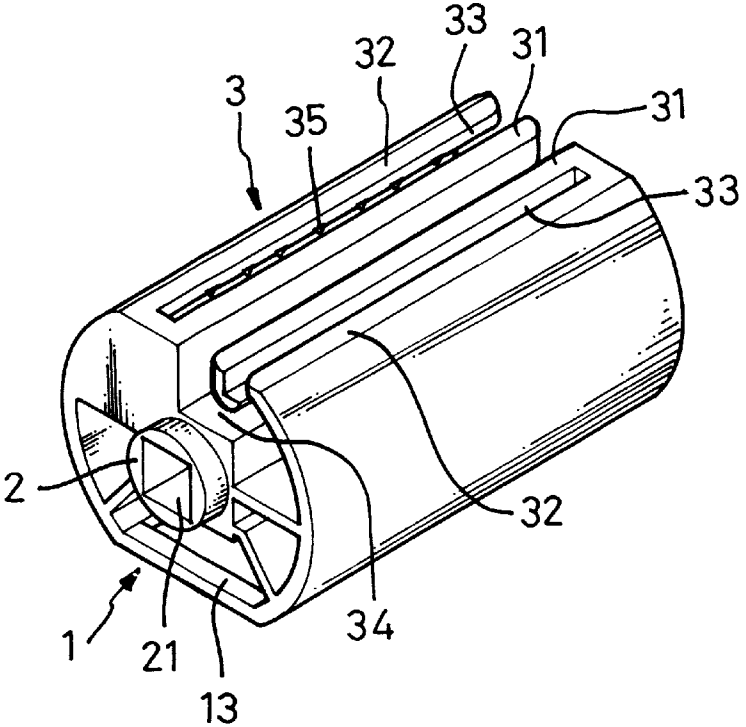
FIG. 2 is another perspective view of a fixing device in a venetian blind in accordance with the present invention illustrating a positioning band passing face opposite to the cord passing face.
Figure 1:
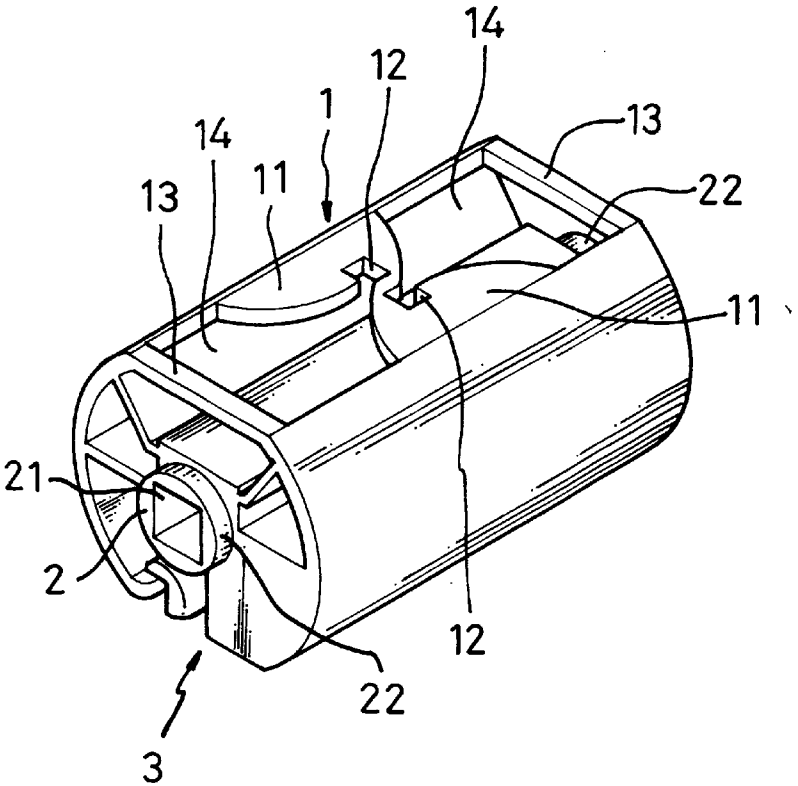
FIG. 1 is a perspective view of a fixing device in a Venetian blind in accordance with the present invention illustrating a cord passing face.
Figure 4:
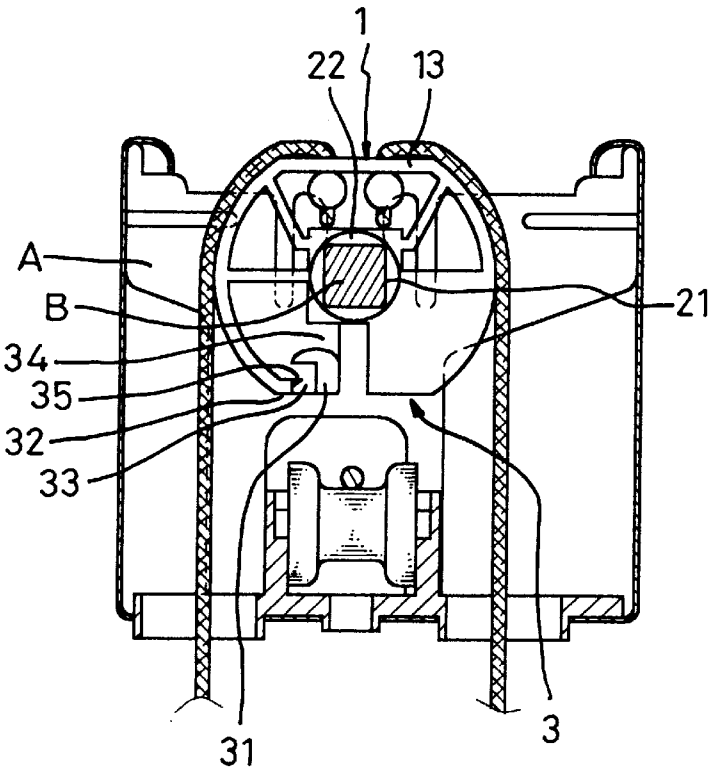
FIG. 4 is a side sectional view of FIG. 3.
Figure 3:
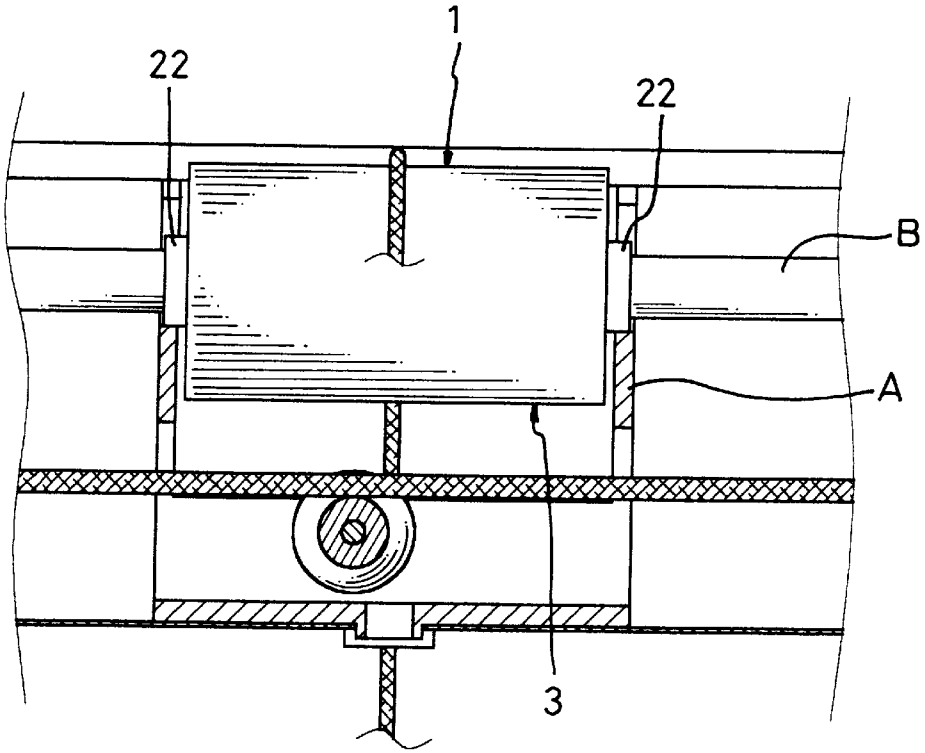
FIG. 3 is a sectional view illustrating the fixing device shown in FIGS. 1 and 2 receiving in an engaging seat.
Figure 5:
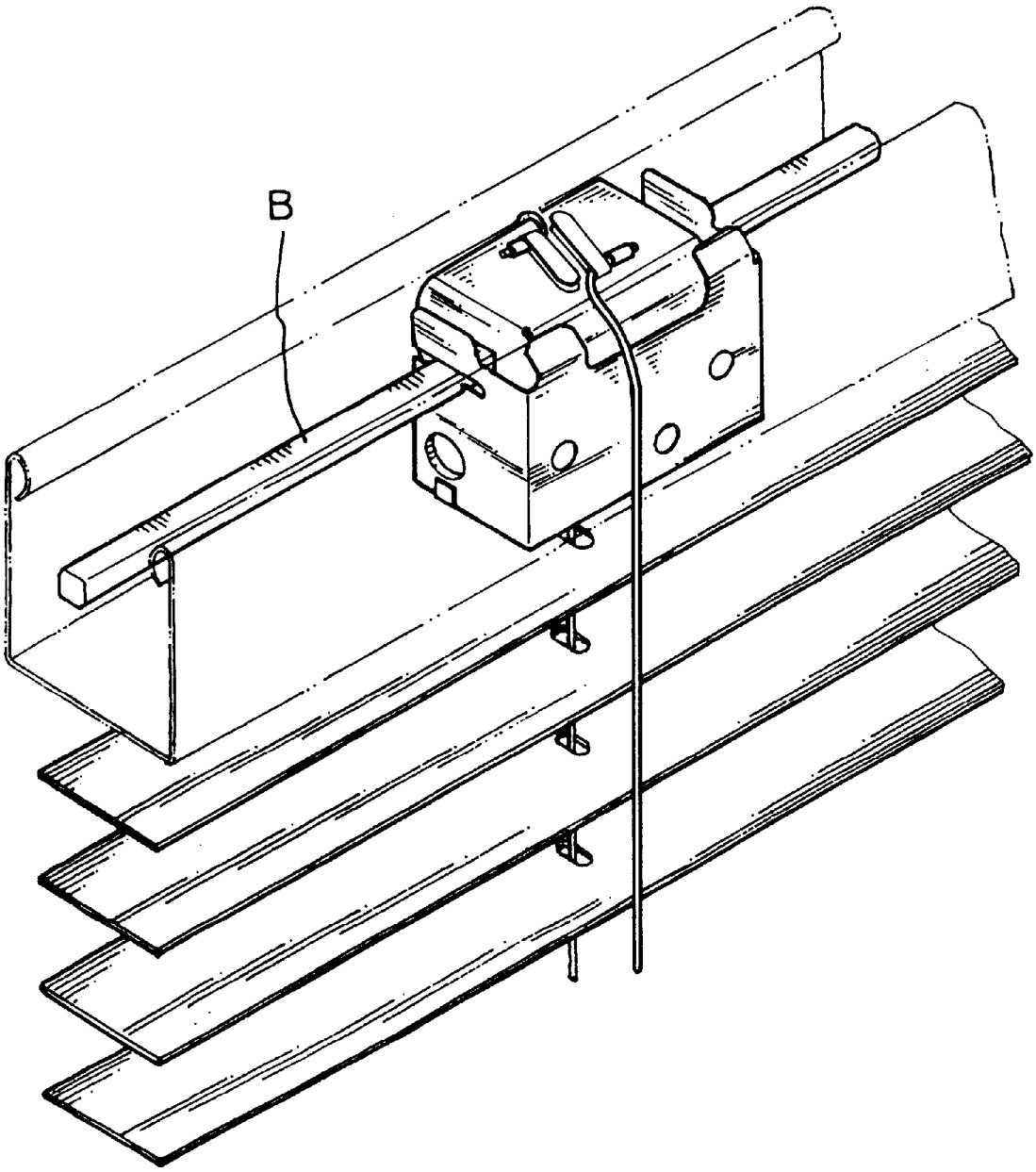
(PRIOR ART) FIG. 5
FIG. 5 is a perspective view of a conventional venetian blind.

Referring to FIGS. 1 through 4, basically, a fixing device in a venetian blind in accordance with the present invention is an integral piece made of high molecular material and comprises a cord engaging part 1, a core 2, and a band passing part 3. The cord engaging part 1 and the band passing part 3 are oppositely disposed to each other with respect to the core 2. The cord engaging part 1 is for fixing a bracing cord and the band passing part 3 is for fixing a positioning band.

The cord engaging part 1 is located at the upper side of a base and integrally has two engaging plates 11, which are oppositely and crossly disposed to each other. A respective engaging groove 12 is provided on both of the engaging plates 11 near a joint part connecting the engaging plates 1. In order to intensifying the strength, a respective rib 13 is integrally provided at both lateral sides of the cord engaging part 1. It can be seen in FIG. 1 that the ribs 13, the engaging plates 11 and the core 2 confine an engaging chamber 14.

The core 2 is located at the central place of the base and is composed of an inner wall dividing the base into the cord engaging part 1 and the band passing part 3 and crossing over the entire base. A through central hole 21 is provided along the axial direction of the base. The through central hole 21 has a cross section corresponding to the cross section of an anal shaft B. The cross section of the shaft B shown is square but it is an example only not a restriction. There are two opposite frames A on the fixing device to support the shaft B and there are two opposite collars 22 on the shaft B corresponding to the frames A so as to engage with the frames A.

The band passing part 3 is oppositely disposed to the cord engaging part 1 as shown in FIG. 2. The band passing part 3 has two opposite and crossly arranged L shaped sticks 31 and each of the sticks 31 has an open end respectively. The other end of each stick 31 is integrally associated with the base such that an elongated gap 33 is formed between the stick 31 and an axial edge 32, respectively. Similarly, a bottom gap 34 is formed between the bottom part of each stick 31 and the base. In order to catch a positioning band, the sticks 31 and the axial edges 32 are provided with integral engaging teeth 35 on vertical surfaces thereof. As mentioned above, the sticks 31 are crossly arranged so that one of the sticks 31 is opened at an end thereof and the other stick 31 is closed at an end thereof opposite to the open end.

Referring to FIGS. 3 and 4 again, while in use, the fixing device is mounted in the frames A on the elongated rod. The central hole 21 is passed through by the axial shaft B and the collars 22 are laid on locating recesses of the frames A respectively to reduce the bearing locations of the shaft B with respect to the fixing device.

The bracing cord can be placed into the engaging chamber 14 from top of the cord engaging part 1 and then the cord may slip into the engaging groove 12. Because the bracing cord has a head end greater than the size of the engaging groove 12, the head end may keep engaging with the groove 12 even if the cord is pulled outward.

The positioning band has enclosed ring ends to be fitted with the sticks 31. Hence, it is not possible for the positioning band to be removed from the fixing device in spite of an outward pull force. In the mean time, the engaging teeth 35 can catch the positioning band to assure the firmness.

It is appreciated that the fixing device in a venetian blind of the present invention provides effectiveness as follows:

(1) A design of crossly opposite arrangement is involved in the fixing device such that an even force can be obtained. Especially, the sticks are designed to arrange symmetrically at right and at left such that an even pull force can be reached to overcome the shortcoming caused from a single direction with single point connection as the prior art does. Therefore, the life span of the fixing device can be enhanced soundly.

(2) The design of crossly opposite arrangement offers the fixing device is not necessary to care the orientation during performing the mounting job such that it becomes easy to set up a venetian blind so as to enhance the assembling efficiency and eliminate an undesirable unidirectional force.

(3) Both lateral sides of the base each provide a collar to lay in the frames respectively such that the force exerting on the axial shaft can be shared to avoid a bending or deforming. Thus, a longer durability can be maintained.

While the invention has been described with reference to a preferred embodiment thereof, it is to be understood that modifications or variations may be easily made without departing from the spirit of is invention, which is defined by the appended claims.

What is claimed is:

1. A fixing device for fixing a bracing cord and a positioning band of a venetian blind assembly, the venetian blind assembly including a rod having a polygonal cross-sectional configuration, the fixing device comprising:

a) an elongated central core having a central through hole with a polygonal cross-sectional configuration matching that of the rod and adapted to slidably receive the rod in the central through hole;

b) a cord attaching portion formed integrally with and located on a first side of the central core, the cord attaching portion including:

i) an engaging chamber; and, ii) an engaging plate located within the engaging chamber and having two, spaced apart engaging grooves, each configured to receive an end of the bracing cord therein, the engaging grooves opening in opposite directions, the engaging plate including, for each engaging groove, two opposed, spaced apart, convexly curved guide surfaces forming a guide passage communicating with the respective engaging groove to guide the end of the bracing cord into the respective engaging groove; and, c) a band attaching portion formed integrally with and located on a second side of the central core opposite to the first side, the band attaching portion including two L-shaped members, each solely supported by a base portion of the L-shaped member such that the L-shaped members form cantilevers, and extend into two oppositely opening elongated gaps whereby the L-shaped members are adapted to retain ends of the positioning bands on the fixing device.

2. The fixing device of claim 1 further comprising engaging teeth formed on each of the L-shaped members.

3. The fixing device of claim 1 wherein opposite outer surfaces of the central core extending between the cord attaching portion and the band attaching portion are each convexly curved.

4. The fixing device of claim 1 wherein the central core has opposite ends and further comprising a collar extending outwardly from each opposite end such that the central through hole extends through both collars.

* * * * *